US011205368B2

(12) United States Patent
Kim et al.

(10) Patent No.: US 11,205,368 B2
(45) Date of Patent: Dec. 21, 2021

(54) DISPLAY DEVICE AND METHOD OF DRIVING THE SAME

(71) Applicant: Samsung Display Co., Ltd., Yongin-si (KR)

(72) Inventors: Jong Man Kim, Yongin-si (KR); Sang Su Han, Yongin-si (KR); Da Eun Kang, Yongin-si (KR); Jae Woo Ryu, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/008,409

(22) Filed: Aug. 31, 2020

(65) Prior Publication Data

US 2021/0233456 A1 Jul. 29, 2021

(30) Foreign Application Priority Data

Jan. 28, 2020 (KR) ..... 10-2020-0010044

(51) Int. Cl.
*G09G 3/20* (2006.01)

(52) U.S. Cl.
CPC ..... *G09G 3/2007* (2013.01); *G09G 2310/027* (2013.01); *G09G 2310/0267* (2013.01); *G09G 2310/08* (2013.01); *G09G 2320/0252* (2013.01); *G09G 2320/0261* (2013.01); *G09G 2320/103* (2013.01)

(58) Field of Classification Search
CPC ..... G09G 3/2007; G09G 2310/08; G09G 2320/103; G09G 2320/0261; G09G 2310/027
See application file for complete search history.

(56) References Cited

U.S. PATENT DOCUMENTS 7,158,107 B2 * 1/2007 Kawabe ..... G09G 3/3611 345/208
7,190,372 B2 * 3/2007 Choi ..... G09G 5/02 345/589
7,916,218 B2 * 3/2011 Choe ..... G09G 3/3406 348/602
9,640,131 B2 * 5/2017 Croxford ..... G09G 5/395
(Continued)

FOREIGN PATENT DOCUMENTS

KR 10-1336629 B1 12/2013
KR 10-1356164 B1 1/2014
(Continued)

*Primary Examiner* — Michael J Jansen, II
(74) *Attorney, Agent, or Firm* — Lewis Roca Rothgerber Christie LLP

(57) ABSTRACT

A display device and a method of driving the same are described. The display device includes: an over driver to overdrive current frame data included in input image data to output overdriving frame data; a data driver to generate a data signal for the current frame data based on the overdriving frame data; and a display panel including a plurality of pixels to receive the data signal, the over driver may calculate a temporal change rate or a spatial change rate of the input image data, and output the overdriving frame data utilizing a reference formula having a first main parameter determined according to the calculated result. Therefore, overdriving may be performed dynamically according to the spatial change rate or the temporal change rate of the input image data.

18 Claims, 7 Drawing Sheets

(56) References Cited

U.S. PATENT DOCUMENTS 9,916,814 B2 * 3/2018 Choi ..... G09G 5/363
10,121,423 B2 * 11/2018 Yeo ..... G09G 3/3648
10,223,764 B2 * 3/2019 Croxford ..... G06T 1/60
10,586,510 B2 * 3/2020 Jun ..... G09G 5/10
2002/0015033 A1 * 2/2002 Kim ..... G09G 3/3208 345/204
2002/0024481 A1 * 2/2002 Kawabe ..... G09G 3/3611 345/87
2003/0091230 A1 * 5/2003 Choi ..... G09G 5/02 382/162
2007/0146380 A1 * 6/2007 Nystad ..... H04N 19/43 345/582
2007/0176916 A1 * 8/2007 Choe ..... G09G 3/3406 345/207
2013/0201124 A1 * 8/2013 Choi ..... G06F 3/0412 345/173
2015/0228248 A1 * 8/2015 Croxford ..... G09G 5/395 345/690
2016/0005342 A1 * 1/2016 Park ..... G09G 3/3208 345/207
2016/0155384 A1 * 6/2016 Kim ..... G09G 3/2025 345/212
2017/0084235 A1 * 3/2017 Yeo ..... G09G 3/3648
2017/0243323 A1 * 8/2017 Croxford ..... H04N 13/106
2018/0075798 A1 * 3/2018 Nho ..... G09G 3/32
2019/0080671 A1 * 3/2019 Jun ..... G09G 5/10
2019/0122627 A1 * 4/2019 Kim ..... G09G 3/3611
2020/0135137 A1 * 4/2020 Kim ..... G09G 3/3696

FOREIGN PATENT DOCUMENTS

KR 10-2015-0093592 A 8/2015
KR 10-2019-0045439 A 5/2019

* cited by examiner

DISPLAY DEVICE AND METHOD OF DRIVING THE SAME

CROSS-REFERENCE TO RELATED APPLICATION

This application claims priority to and the benefit of Korean Patent Application No. 10-2020-0010044, filed on Jan. 28, 2020, the entire content of which is hereby incorporated by reference.

BACKGROUND

1. Field

Embodiments of the present disclosure relate to a display device, and more particularly, to a display device and a method of driving the same.

2. Discussion

With the development of information technology, the importance of display devices, which are a connection medium between users and information, has been emphasized. In response to this, the use of display devices such as a liquid crystal display device, an organic light emitting display device, and a plasma display device has been increasing.

In a display device, each pixel may emit light with luminance corresponding to a data voltage supplied through a data line. The display device may display an image frame by combining light emitted from pixels.

When the response speed of the display device is slow, when rapidly changing or moving content is displayed, an afterimage in which the previous screen (e.g., a previous image frame) and new screen (e.g., a new image frame) overlap each other may occur or a motion blur may occur.

For example, the time it takes to switch from the darkest color to the lightest color, or the time it takes to switch from a mixed color to a neutral color, can be slow.

SUMMARY

Aspects of embodiments of the present disclosure are directed toward a display device capable of performing overdriving according to a temporal change rate or a spatial change rate of input image data based on set or predetermined parameters and a method of driving the same.

However, the aspects of the present disclosure are not limited to the above-described aspects, and other aspects within the spirit and scope of the present disclosure will be apparent to those of ordinary skill in the related art.

One embodiment of the present disclosure for achieving the above aspect provides a display device.

The display device may include: an over driver to overdrive current frame data included in input image data to output overdriving frame data for the current frame data; a data driver to generate a data signal based on the overdriving frame data; and a display panel including a plurality of pixels to receive the data signal.

The over driver may be to calculate a temporal change rate or a spatial change rate of the input image data to obtain a calculated result, and to output the overdriving frame data utilizing a reference formula having a first main parameter determined according to the calculated result.

The over driver may be to output first overdriving frame data for the input image data including a first temporal change rate and a first spatial change rate, and to output second overdriving frame data different from the first overdriving frame data for the input image data including a second temporal change rate equal to the first temporal change rate and a second spatial change rate higher than the first spatial change rate.

The reference formula may be a formula in which a difference value between the overdriving frame data and previous frame data of the current frame data is expressed as a polynomial of the current frame data.

The over driver may include a memory to store main parameters of the reference formula and at least one auxiliary parameter for the first main parameter from among the main parameters.

The previous frame data is DPF, the current frame data is DCF, the overdriving frame data is DOF, and the main parameters are A, B, C, and D, where B is the first main parameter, and the reference formula may be as follows:

$$DOF-DPF=A\cdot DCF^3+B\cdot DCF^2+C\cdot DCF+D.$$

The over driver may be to determine a linear approximation function utilizing the at least one auxiliary parameter, and wherein the over driver may be to input the temporal change rate or the spatial change rate into the linear approximation function to determine the first main parameter.

The linear approximation function may be a function obtained by determining a plurality of reference formulas utilizing data extracted from a plurality of sample patterns and linearly approximating first main parameters according to the plurality of reference formulas.

The plurality of sample patterns may include: a first sample pattern in which a black grayscale level (a black gray level) and a white grayscale level (a while gray level) alternately appear twice or more in each of a first direction and a second direction perpendicular to the first direction in one frame; a second sample pattern in which the black grayscale level and the white grayscale level alternately appear at least once in each of the first direction and the second direction in one frame; and a third sample pattern having a single grayscale level (a single gray level) in one frame.

The first sample pattern may include a region that is changed from the black grayscale level to the white grayscale level or from the white grayscale level to the black grayscale level after one frame interval.

The second sample pattern may include a region that is changed from the black grayscale level to the white grayscale level or from the white grayscale level to the black grayscale level after two frame intervals.

The third sample pattern may include a region that is changed from the black grayscale level to the white grayscale level or from the white grayscale level to the black grayscale level after three frame intervals.

The over driver may be to determine mobility of the reference formula according to the current frame data and the previous frame data, and to output the overdriving frame data utilizing a movement reference formula obtained by shifting the reference formula according to the mobility.

The reference formula may satisfy at least one default data from among default data, and the default data may include: first default data corresponding to a case where grayscale level values of the current frame data, the previous frame data, and the overdriving frame data are the same; and second default data corresponding to a case where a grayscale level value of the current frame data is a maximum grayscale level value.

The previous frame data of data that satisfies the reference formula may have a constant grayscale level value.

Another embodiment of the present disclosure for achieving the above aspect provides a method of driving a display device.

The method of driving the display device may include: calculating a temporal change rate or a spatial change rate with respect to input image data to obtain a calculated result; determining a first main parameter according to the calculated result; determining a reference formula having the first main parameter; and generating overdriving frame data for current frame data included in the input image data utilizing the reference formula.

The reference formula may be a formula in which a difference value between the overdriving frame data and previous frame data of the current frame data is expressed as a polynomial of the current frame data.

The previous frame data is DPF, the current frame data is DCF, the overdriving frame data is DOF, and main parameters of the reference formula are A, B, C, and D, where B is the first main parameter, and the reference formula may be as follows:

$$DOF-DPF=A\cdot DCF^3+B\cdot DCF^2+C\cdot DCF+D$$

The determining the first main parameter may include: determining a linear approximation function utilizing at least one auxiliary parameter stored in a memory; and determining the first main parameter by inputting the temporal change rate or the spatial change rate into the linear approximation function.

The linear approximation function may be a function obtained by determining a plurality of reference formulas utilizing data extracted from a plurality of sample patterns and by linearly approximating first main parameters according to the plurality of reference formulas.

The generating the overdriving frame data may include: determining mobility of the reference formula according to the current frame data and the previous frame data; and generating the overdriving frame data utilizing a movement reference formula obtained by shifting the reference formula according to the mobility.

The reference formula may satisfy at least one default data from among default data, and the default data may include: first default data corresponding to a case where grayscale level values of the current frame data, the previous frame data, and the overdriving frame data are the same; and second default data corresponding to a case where a grayscale level value of the current frame data is a maximum grayscale level value.

The generating the overdriving frame data may include: outputting first overdriving frame data for the current frame data included in the input image data having a first spatial change rate and a first temporal change rate; and outputting second overdriving frame data different from the first overdriving frame data for the current frame data included in the input image data having a second temporal change rate equal to the first temporal change rate and a second spatial change rate higher than the first spatial change rate.

BRIEF DESCRIPTION OF THE DRAWINGS

The accompanying drawings, which are included to provide a further understanding of the present disclosure, and are incorporated in and constitute a part of this specification, illustrate example embodiments of the present disclosure, and, together with the description, serve to explain principles of the present disclosure.

DETAILED DESCRIPTION

Figure 1:
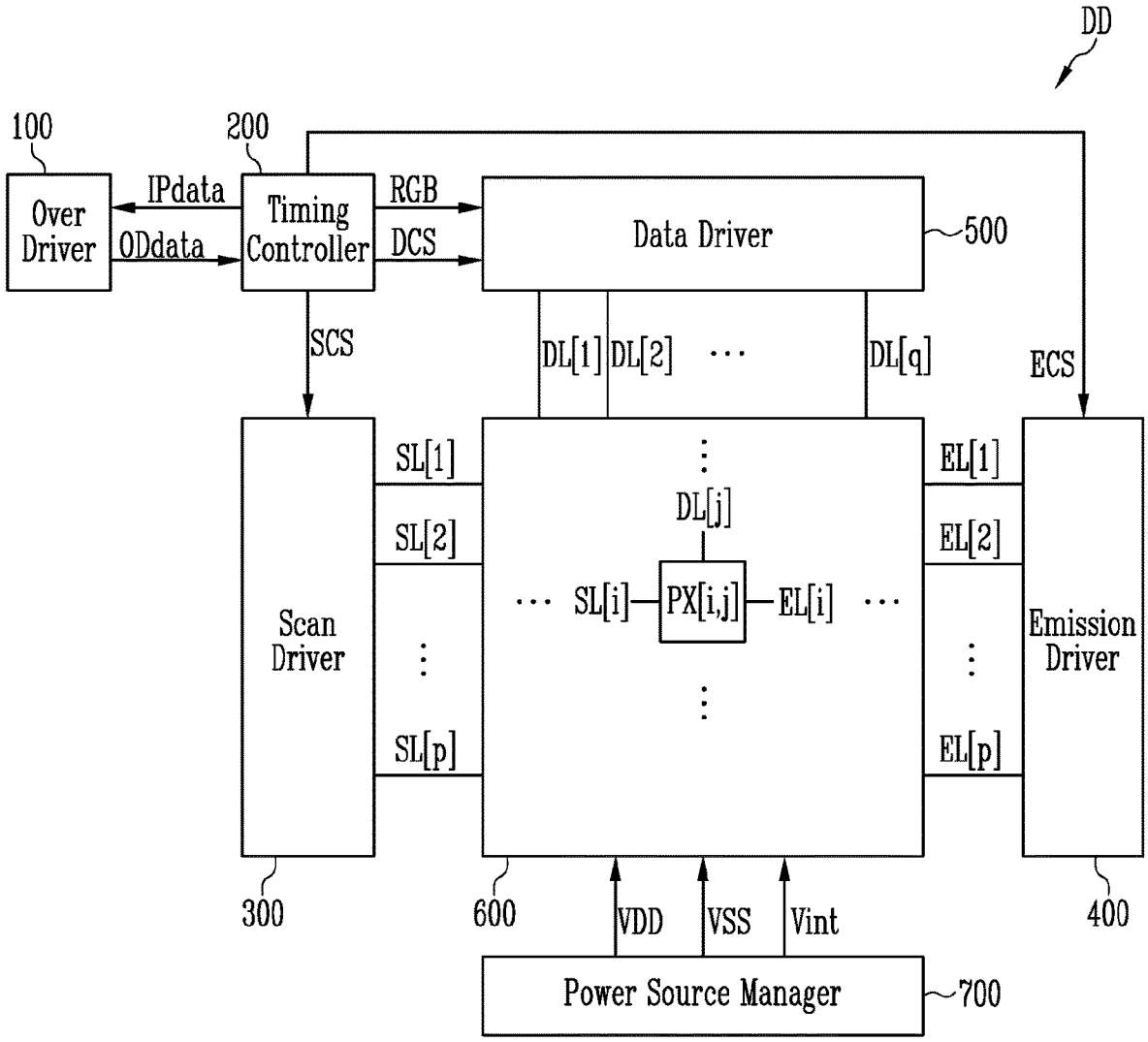
FIG. 1 is a block diagram illustrating a display device according to an embodiment of the present disclosure.

Hereinafter, example embodiments of the present disclosure will be described in more detail with reference to the accompanying drawings so that those of ordinary skill in the art can carry out the present disclosure. The present disclosure may be embodied in various suitable forms and is not limited to the embodiments described herein. As used herein, the use of the term "may," when describing embodiments of the present disclosure, refers to "one or more embodiments of the present disclosure."

In order to clearly describe the present disclosure, parts not related to the description may not be described. The same reference numerals are used for the same or similar elements throughout the specification. Therefore, the reference numerals described above may be used in other drawings.

In addition, the size and thickness of each component shown in the drawings may be exaggerated for convenience of description. The present disclosure is not limited by the embodiments shown in the drawings. In the drawings, the thickness may be exaggerated in order to clearly express various layers and regions. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art.

FIG. 1 is a block diagram illustrating a display device according to an embodiment of the present disclosure.

Referring to FIG. 1, a display device DD may include an over driver 100, a timing controller 200, a scan driver 300, an emission driver 400, a data driver 500, a display panel 600, and a power source manager 700.

The over driver 100 may receive input image data IPdata provided from the timing controller 200 and may overdrive the received input image data IPdata to output overdriving data ODdata.

Overdriving may refer to a method in which a voltage slightly higher (or in some cases lower) than a required voltage level is instantaneously or substantially instantaneously (for example, during one frame period) applied to a pixel PX[i,j] and then lowered to a required target voltage (e.g., the required voltage). The overdriving is a technique for improving the response speed of the display device DD, and may include dynamic capacitance compensation (DCC).

As an example of the overdriving, when a driving voltage higher than the driving voltage of the pixel PX[i,j] according to the input image data IPdata is applied to the pixel PX[i,j], the response speed of the display device DD may be improved due to an overshoot effect.

The over driver 100 may generate the overdriving data ODdata by changing a grayscale level value of the input image data IPdata. For example, the over driver 100 may analyze a temporal change rate (e.g., a temporal frequency of grayscale level values) or a spatial change rate (e.g., a spatial frequency of grayscale level values) of the input image data Ipdata, and convert the input image data IPdata according to a reference formula corresponding to the analyzed result (e.g., the result of the over driver 100 analyzing the temporal change rate of the spatial change rate) to output (e.g., to generate and then output) the overdriving data ODdata.

The timing controller 200 may generate a scan control signal SCS, an emission control signal ECS, and a data control signal DCS in response to synchronization signals supplied from outside. The scan control signal SCS may be supplied to the scan driver 300, the emission control signal ECS may be supplied to the emission driver 400, and the data control signal DCS may be supplied to the data driver 500. In addition, the timing controller 200 may supply the overdriving data ODdata supplied from the over driver 100 to the data driver 500 as an image data RGB, or may modify (e.g., rearrange) the overdriving data ODdata and supply the modified (e.g., rearranged) overdriving data to the data driver 500.

The scan control signal SCS may include a scan start signal and clock signals. A first scan start signal may control a first timing of a scan signal. The clock signals may be utilized to shift the scan start signal (e.g., the first scan start signal).

The emission control signal ECS may include an emission start signal and clock signals. The emission start signal may control a first timing of an emission signal. The clock signals may be utilized to shift the emission start signal.

The data control signal DCS may include a source start pulse and clock signals. The source start pulse may control a starting point of data sampling. The clock signals may be utilized to control a sampling operation.

The scan driver 300 may receive the scan control signal SCS from the timing controller 200, and may sequentially supply scan signals to scan lines SL[1], SL[2], and SL[p] based on the scan control signal SCS. When the scan signals are sequentially supplied, pixels PX[i,j] may be selected in units of horizontal lines (or units of pixel rows), and a data signal (or a data voltage) may be supplied to the selected pixels PX[i,j].

The scan driver 300 may include scan stages composed of shift registers. The scan driver 300 may generate the scan signals by sequentially transmitting the scan start signal (e.g., the first scan start signal) having a turn-on level pulse form to a next scan stage under the control of a clock signal. For example, the scan signals may be sequentially generated and supplied to the scan lines SL[1] to SL[p] as the scan start signal (e.g., the first scan start signal) is sequentially transmitted to the scan stages.

The emission driver 400 may receive the emission control signal ECS from the timing controller 200, and may sequentially supply emission signals to emission control lines EL[1], EL[2], . . . , and EL[p] based on the emission control signal ECS. The emission signals may be utilized to control the emission time of the pixels PX[i,j]. To this end, the emission signals may be set to have wider width than the scan signals. For example, the emission signals may be supplied to the emission control lines EL[1] to EL[p] for a longer time than the scan signals are supplied to the scan lines SL[1] to SL[p].

The data driver 500 may receive the data control signal DCS and the image data RGB from the timing controller 200. Here, the image data RGB may be the same as the overdriving data ODdata of (e.g., received from) the over driver 100, or the image data RGB may be data obtained by modifying (e.g., converting or rearranging) the overdriving data ODdata.

The data driver 500 may generate data signals based on the overdriving data ODdata (e.g., based on the image data RGB), and may supply the data signals (or data voltages) to data lines DL[1], DL[2], . . . , and DL[q] in response to the data control signal DCS. The data signal supplied to the data lines DL[1], DL[2], . . . , and DL[q] may be supplied to the pixels PX[i,j] selected by the scan signal. To this end, the data driver 500 may supply the data signal to the data lines DL[1], DL[2], . . . , and DL[q] to be synchronized with the scan signal.

The display panel 600 may include a plurality of pixels PX[i,j]. The plurality of pixels PX[i,j] may be arranged in p rows and q columns, where p and q are natural numbers. Pixels PX[i,j] disposed in the same row may be connected to the same scan line SL[i] and the same emission control line EL[i]. In addition, pixels PX[i,j] disposed in the same column may be connected to the same data line DL[j].

For example, the pixel PX[i,j] disposed in an i-th row and a j-th column may be connected to the scan line SL[i] corresponding to the i-th row (or a horizontal line), the emission control line EL[i] corresponding to the i-th row, and the data line DL[q] corresponding to the j-th column.

The power source manager 700 may supply a voltage of a first power source VDD, a voltage of a second power source VSS, and a voltage of an initialization power source Vint to the display panel 600. However, this is an example, and at least one selected from among the first power source VDD, the second power source VSS, and the initializing power source Vint may be supplied to the display panel 600 from the timing controller 200 or the data driver 500.

The first power source VDD and the second power source VSS may generate voltages for driving each pixel PX[i,j] of the display panel 600. In an embodiment, the voltage of the second power source VSS may be lower than that of the first power source VDD. For example, the voltage of the first power source VDD may be a positive voltage, and the voltage of the second power source VSS may be a negative voltage. The initialization power source Vint may be a power source that initializes each pixel PX[i,j] included in the display panel 600.

FIG. 1 illustrates that the over driver 100 receives the input image data IPdata from the timing controller 200, but the present disclosure is not limited thereto. For example, the over driver 100 may be integrally implemented inside the timing controller 200. In this case, the timing controller 200 may receive the input image data IPdata from the outside and generate the overdriving data ODdata utilizing the received input image data IPdata.

Figure 2:
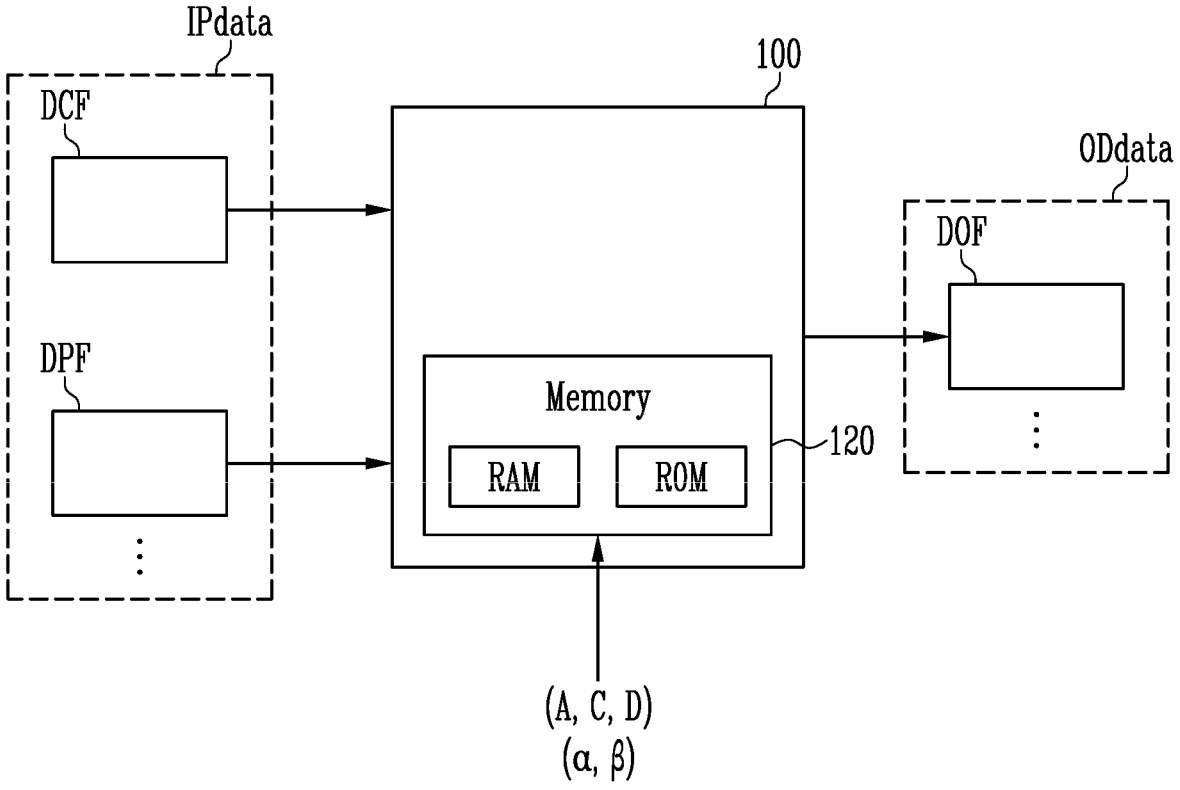
FIG. 2 is a conceptual diagram for explaining a schematic operation of an over driver according to an embodiment of the present disclosure.

FIG. 2 is a conceptual diagram for explaining a schematic operation of an over driver according to an embodiment of the present disclosure.

The input image data IPdata may include current frame data DCF and previous frame data DPF of (e.g., prior to) the current frame data DCF. Here, the previous frame data DPF is frame data temporally older than the current frame data DCF, and the previous frame data DPF may include at least one previous frame data temporally adjacent (e.g., immediately prior to) to the current frame data DCF. The current frame data DCF and/or the previous frame data DPF may include grayscale level values for each pixel.

In addition, the overdriving data ODdata may include at least one overdriving frame data DOF corresponding to each frame data of the input image data IPdata.

The over driver 100 may generate the overdriving frame data DOF for the current frame data DCF utilizing the current frame data DCF and at least one previous frame data DPF. For example, the overdriving frame data DOF may be utilized (e.g., temporarily utilized) to adjust (e.g., temporarily adjust) the data signals supplied to the pixels.

The over driver 100 may include a memory 120 that stores set or predetermined main parameters and auxiliary parameters for at least one selected from among the main parameters.

The over driver 100 may determine a reference formula RF by referring to parameters previously stored in the memory 120, and may generate the overdriving frame data DOF for the current frame data DCF utilizing the determined reference formula RF.

The reference formula RF may be a formula in which a difference value between the overdriving frame data DOF and the previous frame data DPF is expressed as a polynomial of the current frame data DCF. For example, the reference formula RF may be defined as in Equation 1 below.

$$DOF-DPF=A\cdot DCF^3+B\cdot DCF^2+C\cdot DCF+D \quad \text{Equation 1}$$

Referring to Equation 1, DOF may be the overdriving frame data (or a grayscale level value thereof), DPF may be the previous frame data (or a grayscale level value thereof), DCF may be the current frame data (or a grayscale level value thereof), and A, B, C, and D may be suitable main parameters (for example, integers).

Therefore, when the main parameters A, B, C, and D are accurately (e.g., suitably) specified (e.g., set) and the current frame data DCF and the previous frame data DPF are obtained from the input image data IPdata, the overdriving frame data DOF may be determined from Equation 1 above.

In addition, in order for all the main parameters A, B, C, and D to be specified (e.g., set or defined), a pair of the previous frame data DPF and the current frame data DCF corresponding to the number of the main parameters A, B, C, and D, and the overdriving frame data DOF applicable to (e.g., corresponding to) the pair may be required (e.g., utilized).

In this case, all or some of the main parameters A, B, C, and D for defining the reference formula RF may be stored in the memory 120 in advance. In addition, auxiliary parameters α and β for defining at least one selected from among the main parameters A, B, C, and D (for example, B) may be stored in the memory 120 in advance.

Here, the memory 120 may include (e.g., be composed of) at least one selected from among read only memory (ROM) and random access memory (RAM).

Hereinafter, a method of determining the main parameters A, C, and D and the auxiliary parameters α and β that are stored in the memory 120 will be described.

Figure 3:
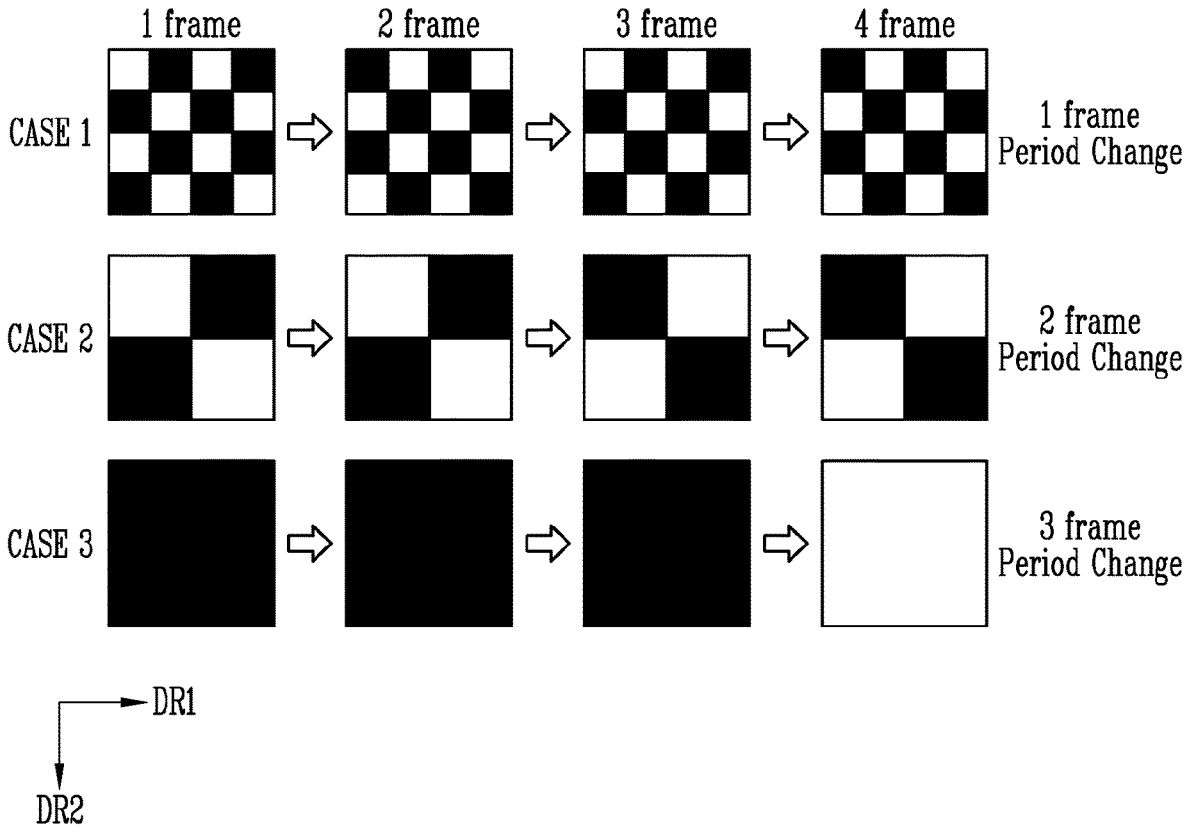
FIG. 3 is an example view illustrating sample patterns for specifying parameters in advance to define a reference formula according to an embodiment of the present disclosure.

FIG. 3 is an example view illustrating sample patterns for specifying (e.g., setting) parameters in advance to define a reference formula according to an embodiment of the present disclosure.

As described above, in order to set or predetermine and store the main parameters A, B, C, and D in the memory, the pair of the previous frame data DPF and current frame data DCF corresponding to the number of the main parameters A, B, C, and D, and the overdriving frame data DOF applicable to (e.g., corresponding to) the pair may be required (e.g., utilized).

Therefore, in an embodiment of the present disclosure, the overdriving frame data DOF for frame data (for example, the current frame data and the previous frame data) of a plurality of sample patterns CASE 1, CASE 2, and CASE 3 may be determined in advance and utilized. Here, the overdriving frame data DOF may be determined based on a change in a device characteristic of the display device DD or a grayscale level value according to the data voltage applied to the pixel.

Here, the plurality of sample patterns CASE 1, CASE 2, and CASE 3 may be image data having at least two or more frames.

A first sample pattern CASE 1 may be pattern images having the highest temporal change rate. For example, the first sample pattern CASE 1 may have a pattern that changes from a black grayscale level to a white grayscale level (or from the white grayscale level to the black grayscale level) every frame from a first frame 1 frame to a fourth frame 4 frame. For example, the first sample pattern CASE 1 may be a pattern including a region, such as one or more pixels, wherein the pattern changes from a black grayscale level to a white grayscale level (or from the white grayscale level to the black grayscale level) every frame from a first frame 1 frame to a fourth frame 4 frame.

In addition, the first sample pattern CASE 1 may be a pattern image having the highest spatial change rate. For example, the first sample pattern CASE 1 may be a pattern in which the black grayscale level and the white grayscale level alternately appear twice or more in a first direction DR1 in one frame. In addition, the first sample pattern CASE 1 may be a pattern in which the black grayscale level and the white grayscale level alternately appear twice or more in a second direction DR2 perpendicular to the first direction DR1 in one frame. For example, the first sample pattern CASE 1 may be a pattern including a plurality of regions arranged in the first and second directions, wherein grayscale level values of the plurality of regions alternate between the black grayscale level and the white grayscale level twice or more in each of the first direction DR1 and the second direction DR2.

A second sample pattern CASE 2 may be pattern images having a smaller temporal change rate than the first sample pattern CASE 1. For example, the second sample pattern CASE 2 may have a pattern that changes from the black grayscale level to the white grayscale level (or from the white grayscale level to the black grayscale level) every two frames from the first frame 1 frame to the fourth frame 4 frame. In addition, the second sample pattern CASE 2 may be a pattern image having a smaller spatial change rate than the first sample pattern CASE 1. For example, the second sample pattern CASE 2 may be a pattern in which the black grayscale level and the white grayscale level alternately appear more than once in the first direction DR1 in one frame. In addition, the second sample pattern CASE 2 may be a pattern in which the black grayscale level and the white grayscale level alternately appear more than once in the second direction DR2 in one frame.

A third sample pattern CASE 3 may be a pattern image having a smaller temporal change rate than the second sample pattern CASE 2. For example, the third sample pattern CASE 3 may have a pattern that changes from the black grayscale level to the white grayscale level (or from the white grayscale level to the black grayscale level) every three frames from the first frame 1 frame to the fourth frame 4 frame. In addition, the third sample pattern CASE 3 may be a pattern image having a smaller spatial change rate than the second sample pattern CASE 2. For example, the third sample pattern CASE 3 may have a single grayscale level (the white grayscale level or the black grayscale level) within one frame.

As described above, the plurality of sample patterns having different (sequentially increasing or decreasing) temporal change rate or spatial change rate may be selected, and the main parameters for the reference formula RF may be determined in advance utilizing the selected sample patterns.

Figure 4:
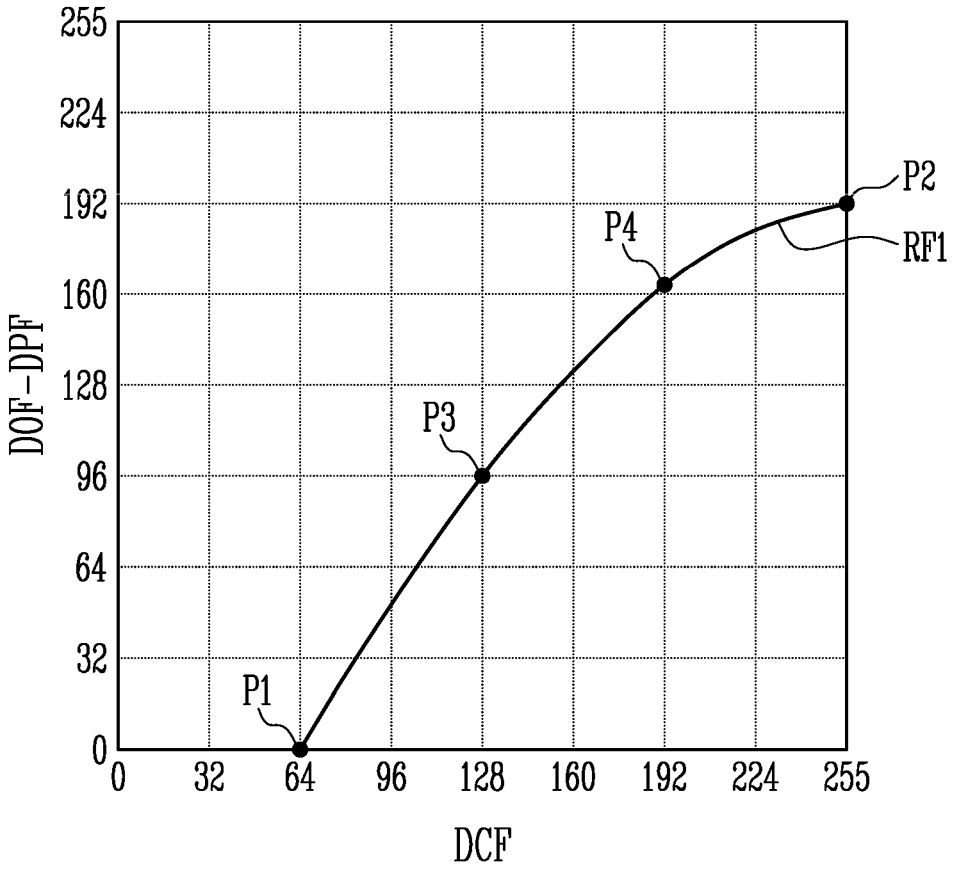
FIG. 4 is a curved graph illustrating a reference formula having main parameters according to an embodiment of the present disclosure.

FIG. 4 is a curved graph illustrating a reference formula having main parameters according to an embodiment of the present disclosure.

All of A, B, C, and D or some of A, B, C, and D (for example, A, C, and D) of the main parameters of the reference formula may be determined utilizing the number of data corresponding to the order of the polynomial. For example, when the reference formula is a third-order polynomial as in Equation 1 described above, the main parameters A, B, C, and D of the reference formula may be determined by applying four data P1, P2, P3, and P4 to Equation 1. For example, the main parameters A, B, C, and D may represent the coefficients of the polynomial of Equation 1, and thus, the main parameters A, B, C, and D may be obtained after the reference formula of Equation 1 is determined.

For example, some A, C, and D of the main parameters A, B, C, and D of the reference formula may be determined utilizing at least two data (e.g., two arbitrary data points from among data points satisfying the reference formula) and two default data (e.g., two data points from among the data points satisfying the reference formula and satisfying a set condition or parameter) extracted from one of the plurality of sample patterns according to FIG. 3 (for example, by applying to Equation 1).

Referring to FIG. 4, a first reference formula RF1 having the main parameters obtained by applying two data P3 and P4 and default data P1 and P2 extracted from the first sample pattern CASE 1 to Equation 1 is shown in a graph.

For example, in the first sample pattern CASE 1, when the previous frame data DPF is a grayscale level value of 64 and the current frame data DCF is a grayscale level value of 128, third data P3 may be extracted by determining the overdriving frame data DOF as a grayscale level value of 160. In addition, in the first sample pattern CASE 1, when the previous frame data DPF is the grayscale level value of 64 and the current frame data DCF is a grayscale level value of 192, fourth data P4 may be extracted by determining the overdriving frame data DOF as a grayscale level value of 224 (160+64).

In addition, the default data may be defined as data according to a case in which the overdriving is not performed.

For example, when the current frame data DCF and the previous frame data DPF are the same and there is no change in the grayscale level value, the overdriving may not be necessary. Accordingly, in this case, the overdriving frame data DOF may be the same as the current frame data DCF. For example, when the current frame data DCF, the previous frame data DPF, and the overdriving frame data DOF are the same (e.g., substantially the same), the data may be shown as data where the y-axis (DOF-DPF) is 0 in the graph of FIG. 4. For example, first data P1 may refer to data according to a case where the grayscale level values of the current frame data DCF, the previous frame data DPF, and the overdriving frame data DOF are all 64 (e.g., substantially 64). As described above, the data for the case where the grayscale level values of the current frame data DCF, the previous frame data DPF, and the overdriving frame data DOF are equal (for example, as the grayscale level value of the first data P1, 64) to each other may be defined as first default data.

When the current frame data DCF is a maximum (e.g., substantially maximum) grayscale level value that can be expressed by the display device DD (for example, 255 as shown in FIG. 4), the overdriving frame data DOF higher than the current frame data DCF may not be applied. For example, second data P2 may refer to data according to a case where the grayscale level value of the current frame data DCF is the maximum (e.g., substantially maximum) grayscale level value. As described above, among the data satisfying the reference formula RF, the data for the case where the grayscale level value of the current frame data DCF is the maximum grayscale level value may be defined as second default data.

As in the first reference formula RF1 shown in FIG. 4, the reference formula may be a formula in which a difference value between the overdriving frame data DOF and the previous frame data DPF is expressed as a polynomial (e.g., a polynomial of the current frame data DCF). Therefore, the previous frame data DPF and the overdriving frame data DOF may be difficult to specify separately.

In order to solve this problem, in an embodiment of the present disclosure, the previous frame data DPF of the data satisfying the reference formula may have a constant grayscale level value. For example, in the curve of the first reference formula RF1 shown in FIG. 4, the previous frame data DPF for the first data P1, the second data P2, the third data P3, and the fourth data P4 may all have the grayscale level value of 64. For example, the graph of the first reference formula RF1 shown in FIG. 4 may be a curve capable of determining the current frame data DCF and the overdriving frame data DOF based on the specified (e.g., set) previous frame data DPF.

Meanwhile, in an embodiment of the present disclosure, one (for example, B) of the main parameters may be dynamically determined according to the temporal change rate or the spatial change rate of the input image data. Hereinafter, this will be described in more detail.

Figure 5:
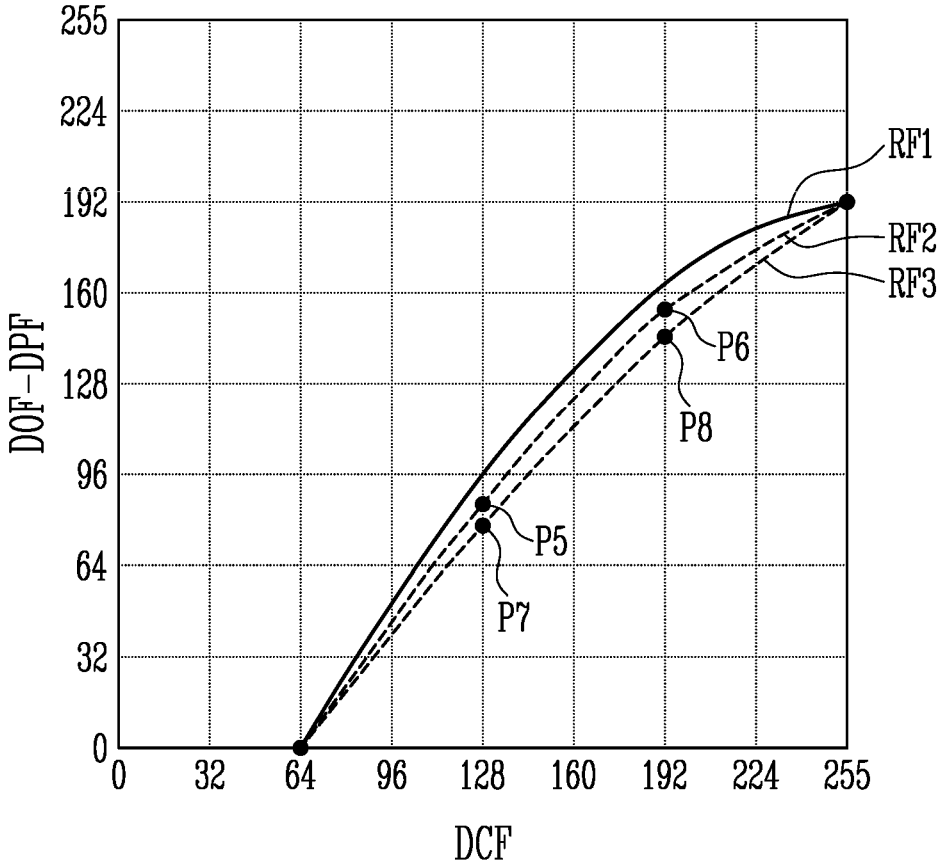
FIG. 5 is a graph illustrating a reference formula that changes as one of the main parameters changes, according to an embodiment of the present disclosure.

FIG. 5 is a graph illustrating a reference formula that changes as one of the main parameters according to an embodiment of the present disclosure changes.

Referring to the first reference formula RF1 shown in FIG. 4, the first reference formula RF1 may include the two default data P1 and P2 and the two data P3 and P4 extracted from the first sample pattern CASE 1. In this case, when the two default data P1 and P2 are maintained, and two data extracted from different sample patterns are utilized, reference formulas RF2 and RF3 may be additionally determined as shown in the graph of FIG. 5. For example, the two default data P1 and P2 may be data points that satisfy each of reference formulas RF1, RF2, and RF3.

Referring to FIG. 5, a second reference formula RF2 determined utilizing two data P5 and P6 extracted from the second sample pattern CASE 2 and two default data (e.g., P1 and P2), and a third reference formula RF3 determined utilizing the two data P7 and P8 extracted from the third sample pattern CASE 3 and two default data (e.g., P1 and P2) are shown as curved graphs.

In this case, the first reference formula RF1, the second reference formula RF2, and the third reference formula RF3 may satisfy the first default data (for example, the first data P1) and the second default data (for example, the second data P2) shown in FIG. 4. For example, fifth data P5 and sixth data P6 satisfying the second reference formula RF2 may be data when the previous frame data DPF is the grayscale level value of 64. In addition, seventh data P7 and eighth data P8 satisfying the third reference formula RF3 may be data when the previous frame data DPF is the grayscale level value of 64. For example, the previous frame data DPF of the data satisfying each of the reference formulas RF2 and RF3 may have a constant grayscale level value of 64.

The second reference formula RF2 and the third reference formula RF3 satisfy Equation 1 as in the first reference formula RF1, but the first main parameter (for example, B) from among the main parameters A, B, C, and D may be different from each other. For example, the main parameters of the first reference formula RF1 may be A, B, C, and D, the main parameters of the second reference formula RF2 may be A, B', C, and D, and the main parameters of the third reference formula RF3 may be A, B", C, and D.

In summary, because the first main parameter (for example, B) is differently determined according to a sample pattern for extracting data, when determining a function for determining the first main parameter B utilizing the sample patterns, the first main parameter B may be dynamically determined according to the input image data IPT.

Figure 6:
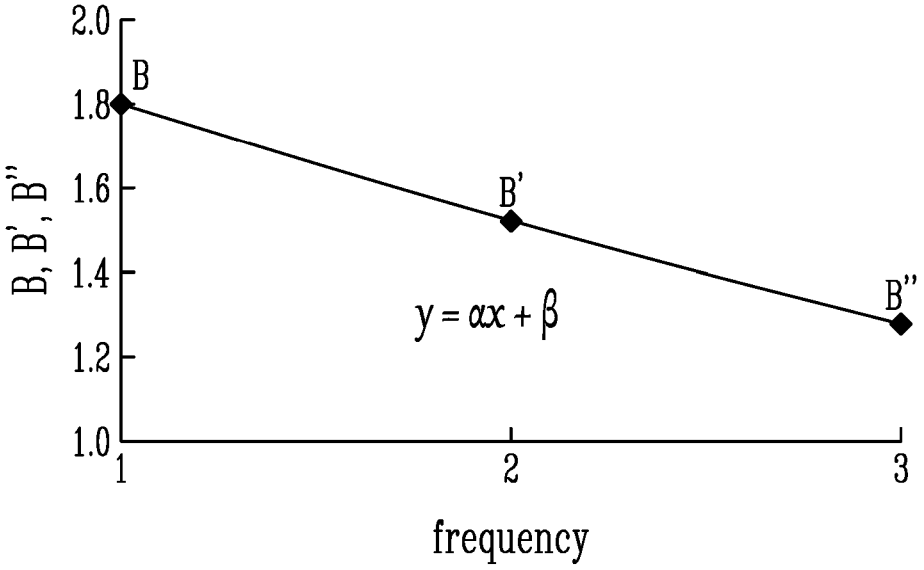
FIG. 6 is a graph illustrating a linear approximation for determining a first main parameter according to an embodiment of the present disclosure.

FIG. 6 is a graph illustrating a linear approximation for determining a first main parameter according to an embodiment of the present disclosure.

As a method for determining the first main parameter (for example, B), a relationship between the sample patterns may be utilized.

In the graph shown in FIG. 6, the horizontal axis represents the temporal change rate or the spatial change rate numerically, and the vertical axis represents the first main parameters B, B', and B" for the first reference formula RF1, the second reference formula RF2, and the third reference formula RF3.

As a method of numerically converting the temporal change rate or the spatial change rate of the sample pattern, various suitable frequency conversion methods including a discrete cosine transform (DCT) may be utilized.

Because the sample patterns CASE 1, CASE 2, and CASE 3 shown in FIG. 3 are sample patterns in which the temporal change rate or the spatial change rate increases or decreases sequentially, the first main parameter B of the reference formulas RF1, RF2, and RF3 may be linearly increased or decreased according to the temporal change rate or the spatial change rate.

Accordingly, the first main parameter B, B', and B" for the reference formulas RF1, RF2, and RF3 may be linearly approximated as a function (hereinafter, referred to as a linear approximation function) satisfying one straight line.

Referring to FIG. 6, the first main parameter B of the first reference formula RF1, the first main parameter B' of the second reference formula RF2 and the first main parameter B" of the third reference formula RF3 may satisfy a linear approximation function ($y=\alpha x+\beta$) that is linearly approximated.

Accordingly, the first main parameter (B in Equation 1) of the reference formula may be determined utilizing the auxiliary parameters $\alpha$ and $\beta$ of the linear approximation function ($y=\alpha x+\beta$). Here, the auxiliary parameters $\alpha$ and $\beta$ for determining the first main parameter B may be stored in the memory 120 in advance.

The graph of FIG. 6 is shown based on the temporal change rate or the spatial change rate of the sample patterns CASE 1, CASE 2, and CASE 3. Therefore, in order to determine the first main parameter B, the temporal change rate or the spatial change rate need to be applied to the linear approximation function ($y=\alpha x+\beta$). According to an embodiment of the present disclosure, the first main parameter B may be dynamically determined by applying the temporal change rate or the spatial change rate of the input image data IPT to the linear approximation function ($y=\alpha x+\beta$).

In this case, the spatial change rate of the input image data IPT may be defined as a frequency calculation value representing a spatial grayscale level value distribution of the current frame data DCF included in the input image data IPT. In addition, the temporal change rate of the input image data IPT may be defined as a frequency calculation value representing a change in temporal grayscale level value of the input image data IPT utilizing one or more previous frame data DPF as well as the current frame data DCF.

As a method of numerically converting the temporal change rate or the spatial change rate of the input image data IPT, various suitable frequency conversion methods including the discrete cosine transform (DCT) may be utilized.

Figure 7:
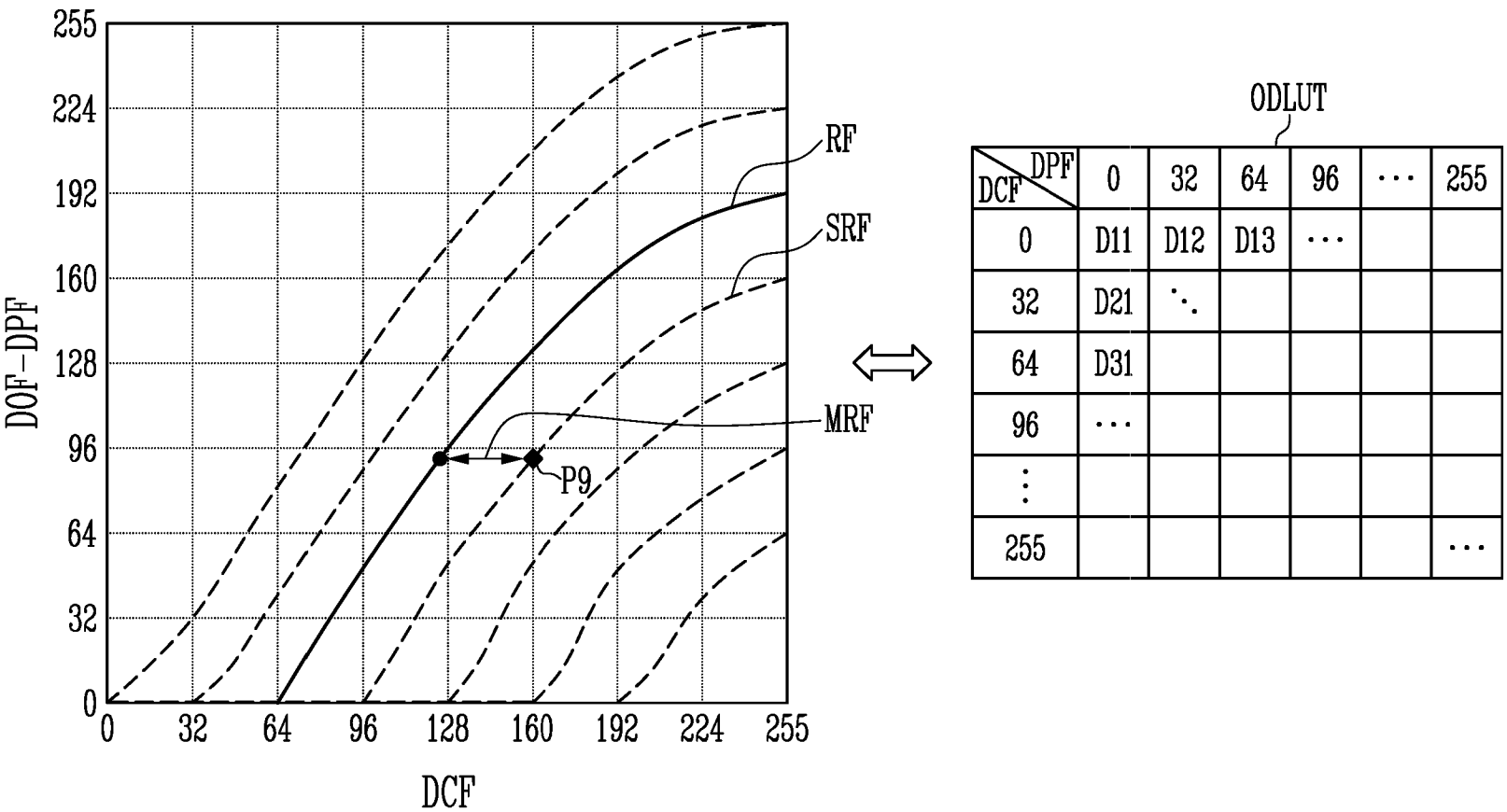
FIG. 7 is a conceptual diagram for explaining mobility of the reference formula according to an embodiment of the present disclosure.

FIG. 7 is a conceptual diagram for explaining mobility of the reference formula according to an embodiment of the present disclosure.

As described above, the previous frame data DPF of the data satisfying the reference formula RF may be constant. However, because the previous frame data DPF and the current frame data DCF are different according to the type or kind of the input image data IPT, it may be difficult to determine all overdriving frame data DOF with one reference formula RF. For example, in the graph shown in FIG. 7, ninth data P9 may not be positioned on the reference formula RF. Therefore, the overdriving frame data DOF according to the ninth data P9 may not be defined utilizing the reference formula RF.

To solve this problem, in an embodiment of the present disclosure, mobility MRF of the reference formula RF may be defined. For example, the mobility MRF may be a value indicating the degree to which the current frame data DCF of the reference formula RF is shifted (or moved in parallel) (e.g., shifted away from the ninth data P9 along the current frame data DCF axis).

For example, in the reference formula RF shown in FIG. 7, when the current frame data DCF is shifted by a grayscale level value of 32, a movement reference formula SRF may be obtained. The movement reference formula SRF shown in FIG. 7 may satisfy the first default data having a grayscale level value of 96. For example, the previous frame data DPF of the movement reference formula SRF shown in FIG. 7 may be 96 (e.g., may be a constant value of 96). As such, the mobility MRF may be differently determined according to the previous frame data DPF or the current frame data DCF of the input image data IPT.

Accordingly, when the reference formula RF is shifted according to the mobility MRF, the movement reference formula SRF satisfying the ninth data P9 may be obtained.

For example, the movement reference formula SRF may be defined as Equation 2 below.

$$DOF-DPF=A\cdot(DCF-MRF)^3+B\cdot(DCF-MRF)^2+C\cdot(DCF-MRF)+D \quad \text{Equation 2}$$

In Equation 2, MRF is the mobility, and the remaining values are the same as in Equation 1, so duplicate descriptions may not be repeated.

According to an embodiment of the present disclosure, some A, C, and D of the main parameters and the auxiliary parameters α and β for determining the first main parameter B may be set or predetermined and stored in the memory 120, and the reference formula RF may be determined utilizing the main parameters A, C, and D and the auxiliary parameters α and β. The movement reference formula SRF may be generated by applying the mobility MRF to the determined reference formula RF, and an overdriving lookup table ODLUT may be generated or replaced utilizing the generated movement reference formula SRF.

The overdriving lookup table ODLUT may be a table in which grayscale level values D11, D12, D13, . . . , D21, . . . , D31, . . . of the overdriving frame data DOF are defined according to a matching relationship between the grayscale level value of the previous frame data DPF and the grayscale level value of the current frame data DCF. When the overdriving lookup table ODLUT is generated in advance in a manufacturing process and stored in the memory 120, a lot of storage capacity of the memory 120 in which the matching relationship between the grayscale level value of the previous frame data DPF and the grayscale level value of the current frame data DCF is stored, may be required.

To solve this problem, according to an embodiment of the present disclosure, the overdriving lookup table ODLUT may be generated by utilizing the reference formula RF and the mobility MRF in real time when the display device DD is driven. In another embodiment of the present disclosure, the overdriving lookup table ODLUT may be replaced with the reference formula RF and the mobility MRF. For example, the reference formula RF and the mobility MRF may be generated in advance in a manufacturing process and stored in the memory 120.

Accordingly, the storage capacity (e.g., the required storage capacity) of the memory 120 for defining the matching relationship between the grayscale level value of the previous frame data DPF and the grayscale level value of the current frame data DCF may be very small.

Referring to the overdriving lookup table ODLUT of FIG. 7, when only the matching relationship between the grayscale level value of the previous frame data DPF and the grayscale level value of the current frame data DCF is utilized, it may be difficult to reflect the spatial change rate of the input image data IPT input to the display device DD.

However, according to an embodiment of the present disclosure, because the first main parameter B of the reference formula RF is determined in consideration of the spatial change rate of the input image data IPT, overdriving result (e.g., overdriving frame data) may vary according to the spatial change rate.

For example, the over driver 100 may output first overdriving frame data with respect to the current frame data DCF included in the input image data IPT having a first spatial change rate and a first temporal change rate. In this case, the over driver 100 may output second overdriving frame data different from the first overdriving frame data with respect to the current frame data DCF included in the input image data IPT having a second temporal change rate equal to the first temporal change rate and a second spatial change rate higher than the first spatial change rate.

Figure 8:
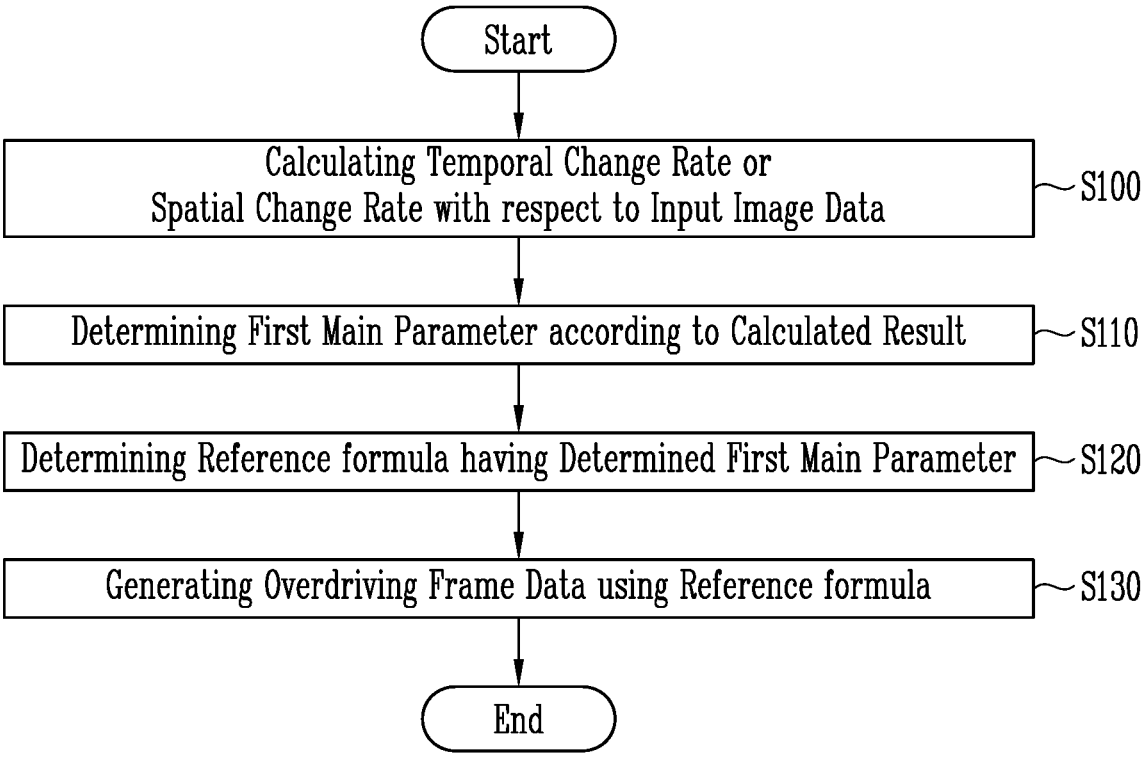
FIG. 8 is a flowchart illustrating a method of driving a display device according to an embodiment of the present disclosure.

FIG. 8 is a flowchart illustrating a method of driving a display device according to an embodiment of the present disclosure.

Referring to FIG. 8, a method of driving the display device DD may include: calculating a temporal change rate or a spatial change rate with respect to input image data IPT (S100); determining a first main parameter B according to the calculated result (S110); determining a reference formula RF having the first main parameter B (S120); and generating overdriving frame data DOF for current frame data DCF included in the input image data IPT utilizing the reference formula RF (S130).

For example, the spatial change rate may be defined as a frequency calculation value representing a spatial grayscale level value distribution of the current frame data DCF. In addition, the temporal change rate may be defined as a frequency calculation value representing a change in temporal grayscale level value of the input image data IPT utilizing one or more previous frame data DPF as well as the current frame data DCF.

The reference formula RF may be a formula in which a difference value between the overdriving frame data DOF and the previous frame data DPF of the current frame data DCF is expressed as a polynomial of the current frame data DCF.

The reference formula RF may be defined according to Equation 1 above.

In the determining the first main parameter (S110), a linear approximation function may be determined utilizing at least one auxiliary parameter stored in a memory, and the first main parameter may be determined by inputting the temporal change rate or the spatial change rate into the linear approximation function.

The linear approximation function may be a function obtained by determining a plurality of reference formulas utilizing data extracted from a plurality of sample patterns and linearly approximating first main parameters according to the plurality of reference formulas.

In the generating the overdriving frame data (S130), mobility of the reference formula may be determined according to the current frame data and the previous frame data, and the overdriving frame data may be generated utilizing a movement reference formula obtained by shifting the reference formula according to the determined mobility.

The reference formula may satisfy at least one default data. The default data may include first default data corresponding to a case where grayscale level values of the current frame data, the previous frame data, and the overdriving frame data are the same, and second default data corresponding to a case where the grayscale level value of the current frame data is the maximum grayscale level value.

In addition, the description related to FIGS. 1 to 7 described above may apply to the method of driving the display device DD.

According to the display device of the present disclosure and the method of driving the same, because the entire lookup table for overdriving is not stored in the memory, the storage capacity of the memory can be minimized or reduced. In addition, because overdriving data may be determined in real time according to the input image data by utilizing set or predetermined parameters, overdriving of the input image data can be improved or optimized.

The device and/or any other relevant devices or components according to embodiments of the present invention described herein may be implemented utilizing any suitable hardware, firmware (e.g. an application-specific integrated circuit), software, or a combination of software, firmware, and hardware. For example, the various components of the device may be formed on one integrated circuit (IC) chip or on separate IC chips. Further, the various components of the device may be implemented on a flexible printed circuit film, a tape carrier package (TCP), a printed circuit board (PCB), or formed on one substrate. Further, the various components of the device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The drawings referred to herein and the detailed description of the present disclosure described above are merely illustrative of the present disclosure. It is to be understood that the present disclosure has been disclosed for illustrative purposes only and is not intended to limit the scope of the present disclosure described in the claims and equivalents thereof. Therefore, those skilled in the art will appreciate that various suitable modifications and equivalent embodiments are possible without departing from the scope of the present disclosure. Accordingly, the true scope of the present disclosure should be determined by the technical idea of the appended claims and equivalents thereof.

What is claimed is:

1. A display device comprising:

an over driver to overdrive current frame data included in input image data to output overdriving frame data for the current frame data;

a data driver to generate a data signal based on the overdriving frame data; and a display panel including a plurality of pixels to receive the data signal, wherein the over driver is to calculate a temporal change rate or a spatial change rate of the input image data to obtain a calculated result, and to output the overdriving frame data utilizing a reference formula having a first main parameter determined according to the calculated result, wherein the reference formula is a formula in which a difference value between the overdriving frame data and previous frame data of the current frame data is expressed as a polynomial of the current frame data, and wherein the over driver is to output the overdriving frame data utilizing a movement reference formula obtained by shifting the reference formula according to mobility of the reference formula.

2. The display device of claim 1, wherein the over driver is to output first overdriving frame data for the input image data, the input image data including a first temporal change rate and a first spatial change rate, and to output second overdriving frame data different from the first overdriving frame data for the input image data, the input image data including a second temporal change rate equal to the first temporal change rate and a second spatial change rate higher than the first spatial change rate.

3. The display device of claim 1, wherein the over driver includes a memory to store main parameters of the reference formula and at least one auxiliary parameter for the first main parameter from among the main parameters.

4. The display device of claim 3, wherein the previous frame data is DPF, the current frame data is DCF, the overdriving frame data is DOF, and the main parameters are A, B, C, and D, where B is the first main parameter, and wherein the reference formula is as follows:

$$DOF-DPF=A\cdot DCF^3+B\cdot DCF^2+C\cdot DCF+D.$$

5. The display device of claim 3, wherein the over driver is to determine a linear approximation function utilizing the at least one auxiliary parameter, and wherein the over driver is to input the temporal change rate or the spatial change rate into the linear approximation function to determine the first main parameter.

6. The display device of claim 5, wherein the linear approximation function is a function obtained by determining a plurality of reference formulas utilizing data extracted from a plurality of sample patterns and linearly approximating first main parameters according to the plurality of reference formulas.

7. The display device of claim 6, wherein the plurality of sample patterns includes:

a first sample pattern in which a black grayscale level and a white grayscale level alternately appear twice or more in each of a first direction and a second direction perpendicular to the first direction in one frame;

a second sample pattern in which the black grayscale level and the white grayscale level alternately appear at least once in each of the first direction and the second direction in one frame; and a third sample pattern having a single grayscale level in one frame.

8. The display device of claim 7, wherein the first sample pattern includes a region that is changed from the black grayscale level to the white grayscale level or from the white grayscale level to the black grayscale level after one frame interval, wherein the second sample pattern includes a region that is changed from the black grayscale level to the white grayscale level or from the white grayscale level to the black grayscale level after two frame intervals, and wherein the third sample pattern includes a region that is changed from the black grayscale level to the white grayscale level or from the white grayscale level to the black grayscale level after three frame intervals.

9. The display device of claim 1, wherein the over driver is to determine the mobility according to the current frame data and the previous frame data.

10. The display device of claim 1, wherein the reference formula satisfies at least one default data from among default data, and wherein the default data includes:

first default data corresponding to a case where grayscale level values of the current frame data, the previous frame data, and the overdriving frame data are the same; and second default data corresponding to a case where a grayscale level value of the current frame data is a maximum grayscale level value.

11. The display device of claim 1, wherein the previous frame data of data that satisfies the reference formula has a constant grayscale level value.

12. A method of driving a display device, the method comprising:

calculating a temporal change rate or a spatial change rate with respect to input image data to obtain a calculated result;

determining a first main parameter according to the calculated result;

determining a reference formula having the first main parameter; and generating overdriving frame data for current frame data included in the input image data utilizing the reference formula, wherein the reference formula is a formula in which a difference value between the overdriving frame data and previous frame data of the current frame data is expressed as a polynomial of the current frame data, and wherein the generating the overdriving frame data includes utilizing a movement reference formula obtained by shifting the reference formula according to mobility of the reference formula.

13. The method of claim 12, wherein the previous frame data is DPF, the current frame data is DCF, the overdriving frame data is DOF, and main parameters of the reference formula are A, B, C, and D, where B is the first main parameter, and wherein the reference formula is as follows:

$$DOF-DPF=A\cdot DCF^3+B\cdot DCF^2+C\cdot DCF+D.$$

14. The method of claim 12, wherein the determining the first main parameter includes:

determining a linear approximation function utilizing at least one auxiliary parameter stored in a memory; and determining the first main parameter by inputting the temporal change rate or the spatial change rate into the linear approximation function.

15. The method of claim 14, wherein the linear approximation function is a function obtained by determining a plurality of reference formulas utilizing data extracted from a plurality of sample patterns and by linearly approximating first main parameters according to the plurality of reference formulas.

16. The method of claim 12, wherein the generating the overdriving frame data includes:

determining the mobility according to the current frame data and the previous frame data.

17. The method of claim 12, wherein the reference formula satisfies at least one default data from among default data, and wherein the default data includes:

first default data corresponding to a case where grayscale level values of the current frame data, the previous frame data, and the overdriving frame data are the same; and second default data corresponding to a case where a grayscale level value of the current frame data is a maximum grayscale level value.

18. The method of claim 12, wherein the generating the overdriving frame data includes:

outputting first overdriving frame data for the current frame data included in the input image data, the input image data having a first spatial change rate and a first temporal change rate; and outputting second overdriving frame data different from the first overdriving frame data for the current frame data included in the input image data, the input image data having a second temporal change rate equal to the first temporal change rate and a second spatial change rate higher than the first spatial change rate.

* * * * *